US007437089B2

(12) United States Patent
Okada

(10) Patent No.: US 7,437,089 B2
(45) Date of Patent: Oct. 14, 2008

(54) IMAGE FORMING DEVICE HAVING AN ALTERNATING CURRENT FREQUENCY REGULATING APPARATUS

(75) Inventor: Katsumi Okada, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 391 days.

(21) Appl. No.: 11/259,144

(22) Filed: Oct. 27, 2005

(65) Prior Publication Data

US 2007/0098424 A1 May 3, 2007

(51) Int. Cl.
*G03G 15/02* (2006.01)

(52) U.S. Cl. ..... 399/50; 399/89

(58) Field of Classification Search ..... 399/50, 399/89

See application file for complete search history.

(56) References Cited

FOREIGN PATENT DOCUMENTS

JP 2002207352 A * 7/2002

* cited by examiner

*Primary Examiner*—David M. Gray
*Assistant Examiner*—Ryan D Walsh
(74) *Attorney, Agent, or Firm*—Global IP Counselors, LLP

(57) ABSTRACT

The size of a resonance noise due to a signal of an alternating voltage applied to a charging member (charging roller) is detected by a piezoelectric device (PZ), and in cases in which the size of the detected resonance noise (detection signal level) exceeds a predetermined size, the frequency of the alternating voltage signal applied to the charging member is shifted, by a control unit (50), by a predetermined frequency amount only.

9 Claims, 9 Drawing Sheets

IMAGE FORMING DEVICE HAVING AN ALTERNATING CURRENT FREQUENCY REGULATING APPARATUS

FIELD OF THE INVENTION

The present invention relates to an image forming device for charging an image holding body (photoreceptor drum) by a contact electrification method, when forming an image by an electrophotographic method.

BACKGROUND INFORMATION

Among image forming devices such as copy machines, printers, facsimiles, and the like, for forming images using electrophotographic methods, are devices that use contact electrification methods to charge a photoreceptor drum surface by bringing into contact a charging member, such as a roller, a blade, or the like, to which a voltage is applied, with a photoreceptor drum (an image holding body).

Among these contact electrification methods, for preventing non-uniform charging (for charge equalization) of the photoreceptor drum surface, a method (referred to as an AC contact electrification method, below) is known, in which direct voltage (DC electric field) and alternating voltage (AC electric field) are superimposed and applied to the charging member.

In this AC contact electrification method, due to adding the alternating voltage (AC electric field) to the charging member, on account of the electrostatic adsorbability thereof, there are cases in which the charging member and the photoreceptor drum resonate, and extremely jarring noise (resonance noise due to alternating voltage signals) known as charging noise, occurs.

As a preventative measure against this type of charging noise, for example, insertion of an anti-vibration member, such as a weight, rubber, or the like, inside the photoreceptor drum is possible.

Additionally, methods for reducing the charging noise, by the structure, material, or dimensions of the charging member, are proposed.

Methods of preventing the charging noise (resonance) by applying irregular variations (fluctuations) to the frequency of the alternating voltage applied to the charging member, by a chaos generator, are also proposed.

Furthermore, it is proposed to set the frequency of the alternating voltage applied to the charging member as low as possible, in a range in which the occurrence of moiré image interference fringes in image formation can be prevented when forming the images.

However, in the prior art in which an anti-vibration member is inserted in the photoreceptor drum, and in methods in which the charging noise is reduced by the structure of the charging member, there have been problems in that manpower required in manufacturing the photoreceptor drum increases (resulting in higher manufacturing costs), and the charging noise is generated due to changes in the charging member and the photoreceptor drum over time (degradation with time). That is, as a result of variations in elastic resonance frequency of the photoreceptor drum or the charging member, due to changes over time, such as film thickness abrasion in the photoreceptor drum, surface layer abrasion in the charging member, rattling, and the like, there have been potential problems in that resonance occurs at harmonic frequencies of four times or six times the frequency of the alternating voltage applied to the charging member, and extremely jarring charging noise occurs. In these cases, outside of changing the degraded member, there is no strategy for eliminating the charging noise.

In addition, with the method of preventing the charging noise using the chaos generator, since fluctuations are given to the frequency of the applied alternating voltage, there has been a problem in that uniform charging of the photoreceptor drum is impaired.

Moreover, since the method using the chaos generator and the method of setting the frequency of the alternating voltage applied to the charging member low, as described above, in each case, are not in response to the state of the charging noise generation, there has been a problem in that conditions occur in which the charging noise cannot be effectively curtailed, or that the frequency of the applied alternating voltage is varied unnecessarily, so that it adversely affects image quality.

Accordingly, the present invention was made in view of the abovementioned circumstances, and has as an object the provision of an image forming device that uses an AC contact electrification method that can assuredly reduce the generation of the charging noise (resonance noise) according to condition variations, while preventing adverse affects on the image quality.

SUMMARY OF THE INVENTION

In order to realize the abovementioned objects, the present invention is applicable to image forming devices that use a contact electrification method that charges the surface of an image holding body by applying superimposed voltage, of direct voltage and alternating voltage, to a charging member in contact with the image holding body, a means being provided for detecting the size of resonance noise, by a signal (referred to as an applied alternating voltage signal, below) of the alternating voltage applied to the charging member, and, based on the size of the resonance noise detected thereby, the frequency of the applied alternating voltage signal is regulated.

In this way, the frequency of the applied alternating voltage signal can be regulated, in accordance with the state of the actual resonance noise generated, so that it is outside the resonance frequency band of the device, and the generation of resonance noise can be assuredly reduced. Moreover, since frequency regulation of the applied alternating voltage signal is performed only when the generation of the resonance noise or symptoms thereof is detected, adverse affects on image quality can be kept to a minimum.

Here, possible means for detecting the resonance noise include, for example, a means that detects the size of the resonance noise by detecting sound pressure level of the resonance noise using a piezoelectric device, or a means in which a buzzer sound output unit (that is, a speaker) in a warning buzzer output means, normally provided in an image forming device to give warnings when there is no more paper, when there is a paper jam, or when various other error conditions occur, is dually used as a detector for detecting the size of the resonance noise.

Furthermore, as a method for regulating the applied alternating voltage signal, for example, in cases in which the size of the detected resonance noise (level of detection signal, or the like) exceeds a size that is set in advance, the frequency of the applied alternating voltage signal can be shifted in a plus direction or a minus direction by a preset frequency amount only.

According to the present invention, by detecting the actual resonance generation state by the alternating voltage signal applied to the charging unit, and, based on this detected result, by regulating the frequency of the applied alternating voltage signal so that it is outside the resonance frequency, generation of the resonance frequency can be assuredly reduced. Moreover, since the frequency regulation of the applied alternating voltage signal can be performed only when the generation of the resonance noise or symptoms thereof is detected, adverse affects on the image quality can be kept to a minimum.

DETAILED DESCRIPTION OF THE PREFERRED EMBODIMENTS

An embodiment of the present invention is explained below, referring to the accompanying figures, so that the present invention may be understood. Moreover, the embodiment below is a specific example of the present invention and should not be construed as limiting the technological bounds of the present invention.

Figure 1:
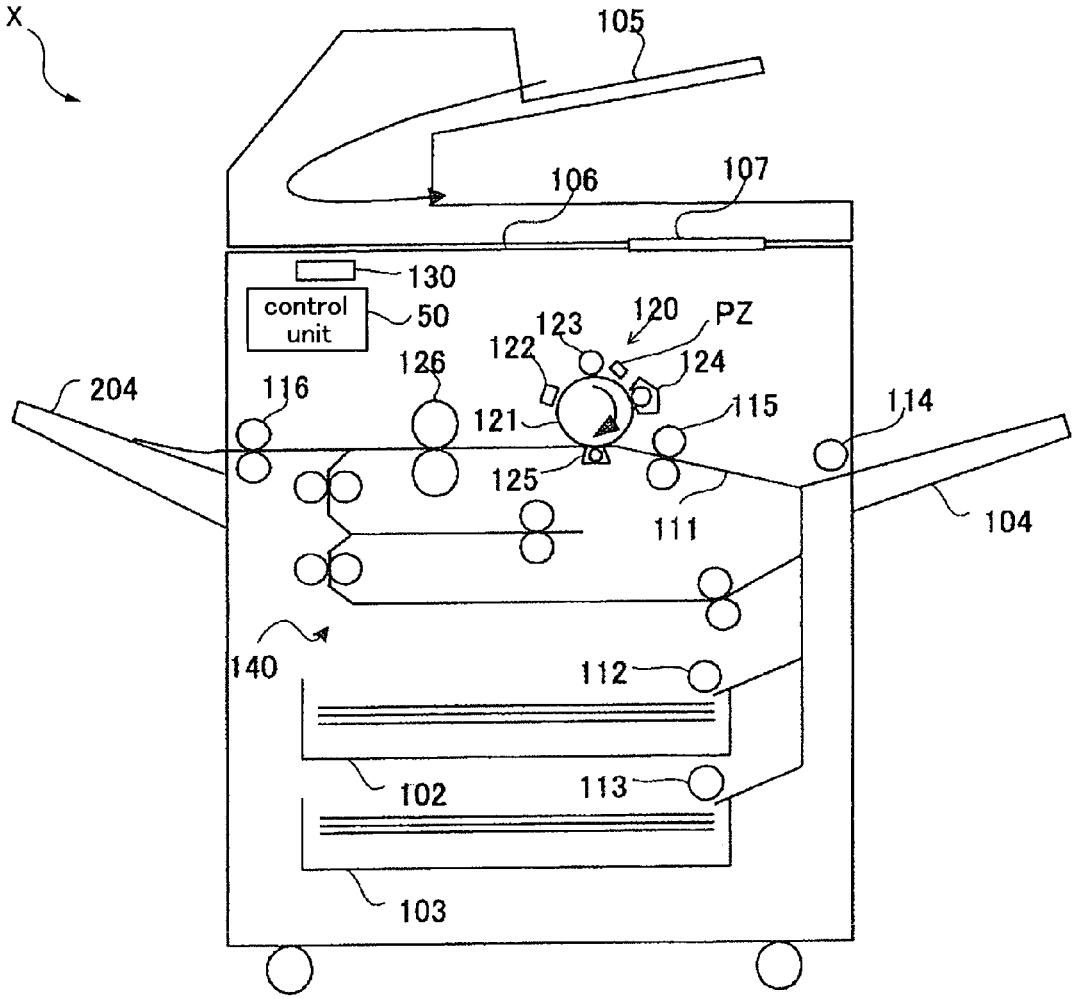
FIG. 1 is an overall configuration schematic view of an image forming device X related to an embodiment of the present invention.
Figure 2:
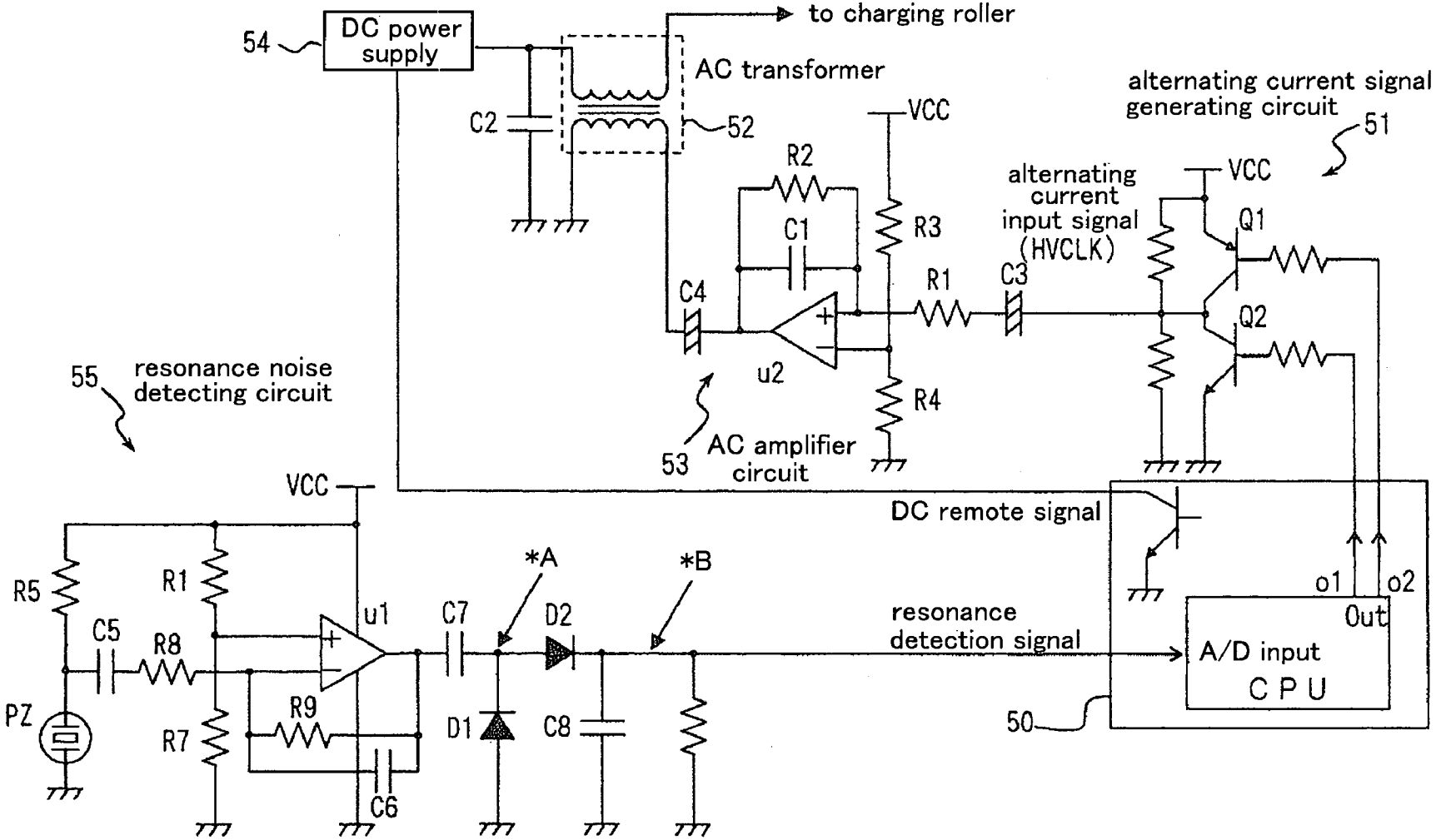
FIG. 2 is a circuit configuration diagram related to detection of resonance noise and regulation of frequency of alternating voltage applied to a charging roller in the image forming device X.
Figure 3:
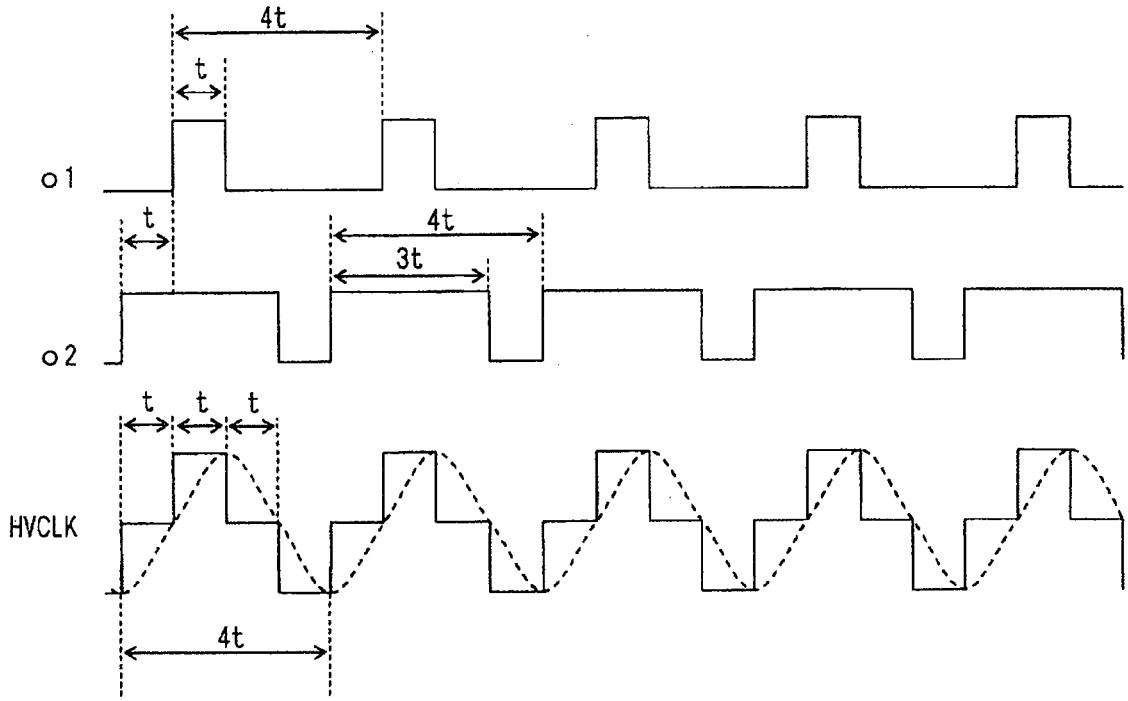
FIG. 3 is a timing chart for an input/output signal of an alternating current signal generating circuit 51 for the image forming device X.
Figure 4:
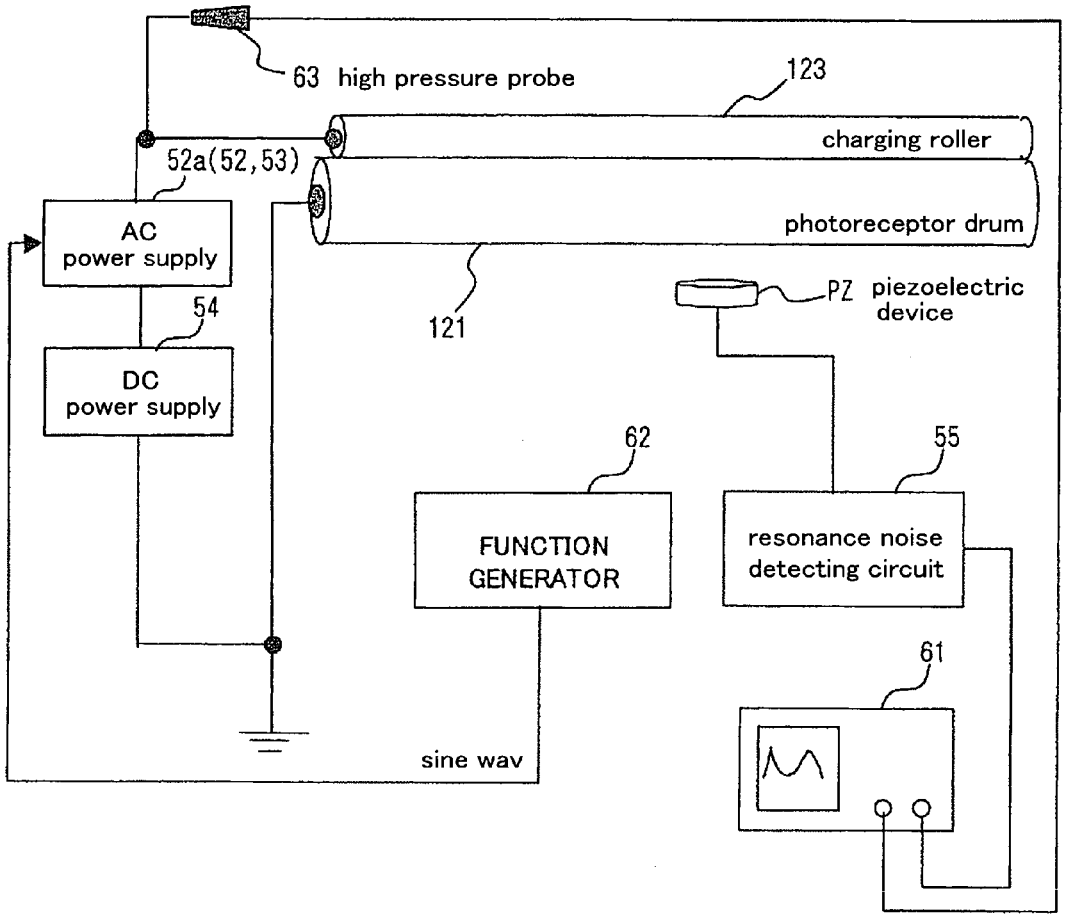
FIG. 4 is a block diagram representing an outline configuration of an experimental device used in a resonance confirmation experiment for the image forming device X.
Figure 5A:
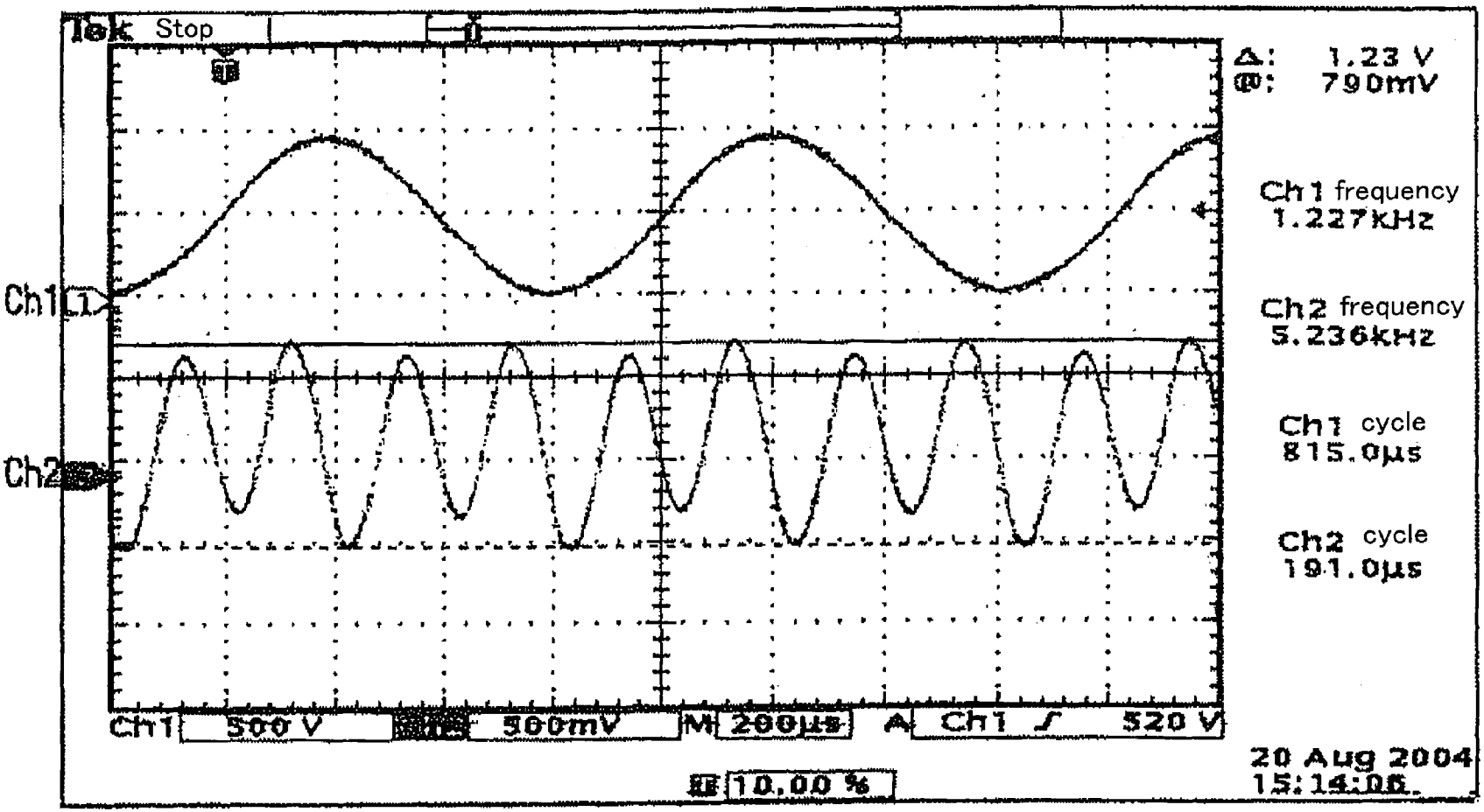
FIGS. 5A, 5B, and 5C are diagrams representing wave forms (Ch1) of the alternating voltage signal applied to the charging roller, and wave forms (Ch2) of a detection signal of a resonance noise detecting circuit for the image forming device X.
Figure 5B:
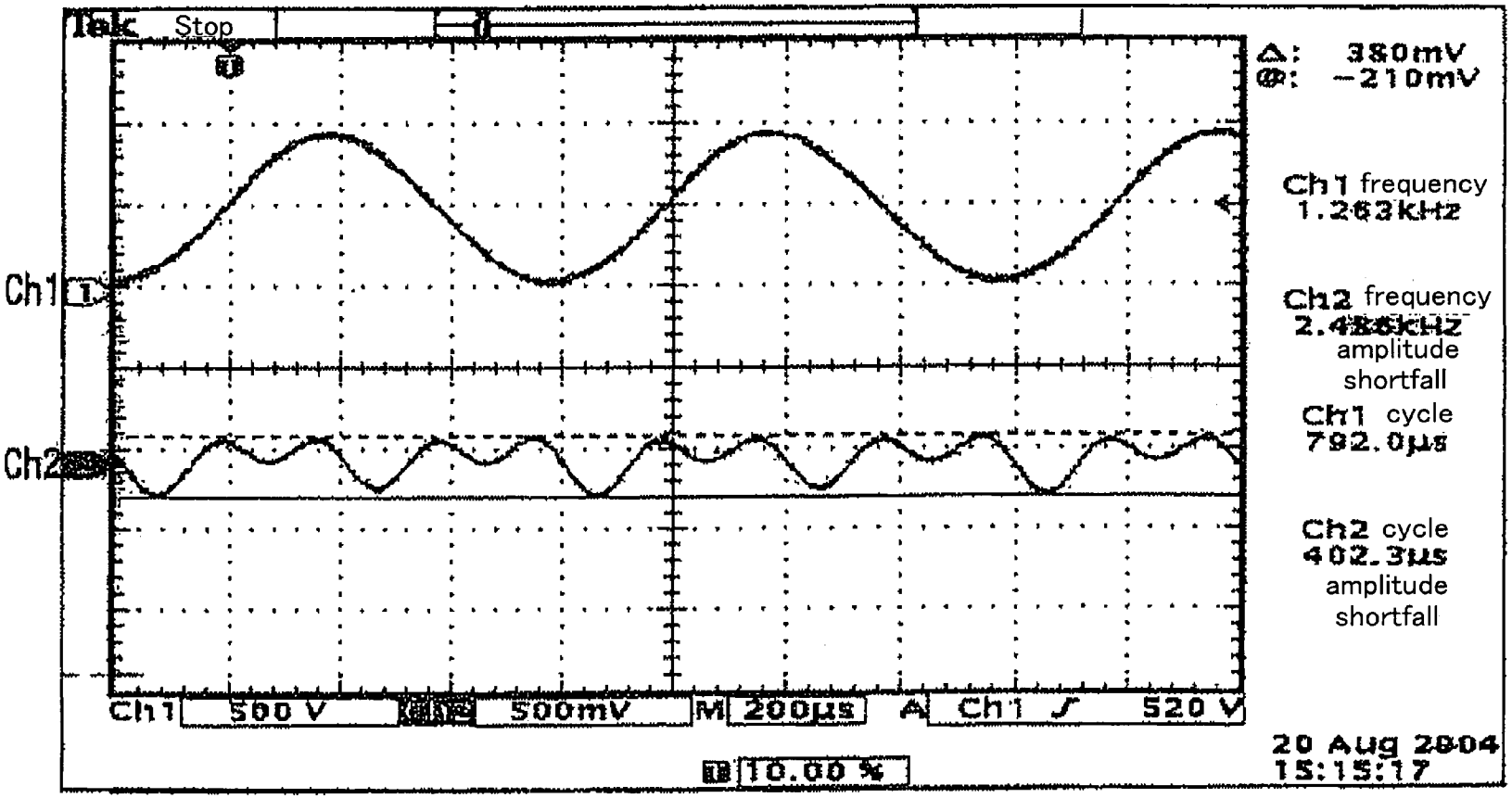
Figure 5C:
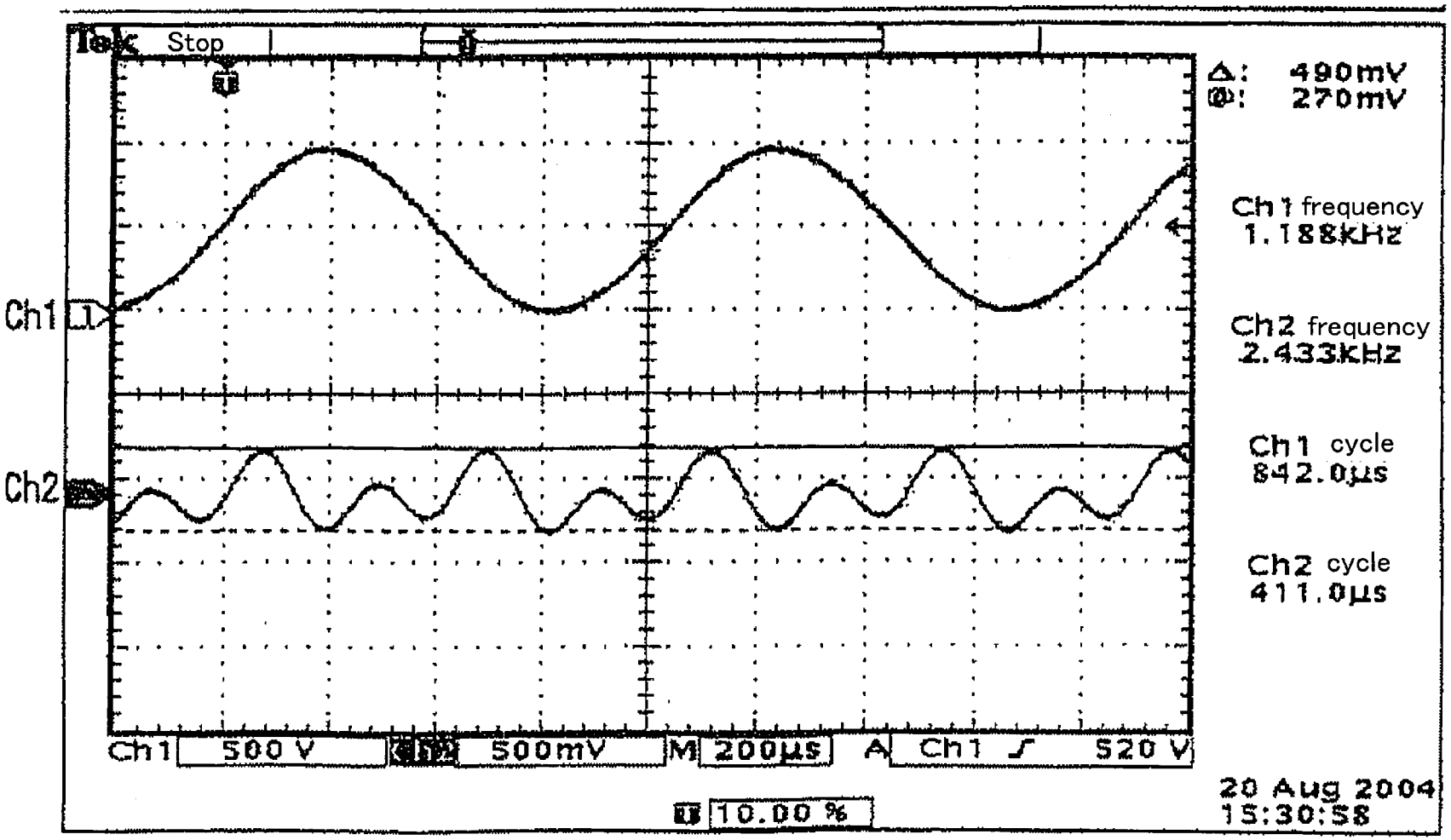
Figure 6:
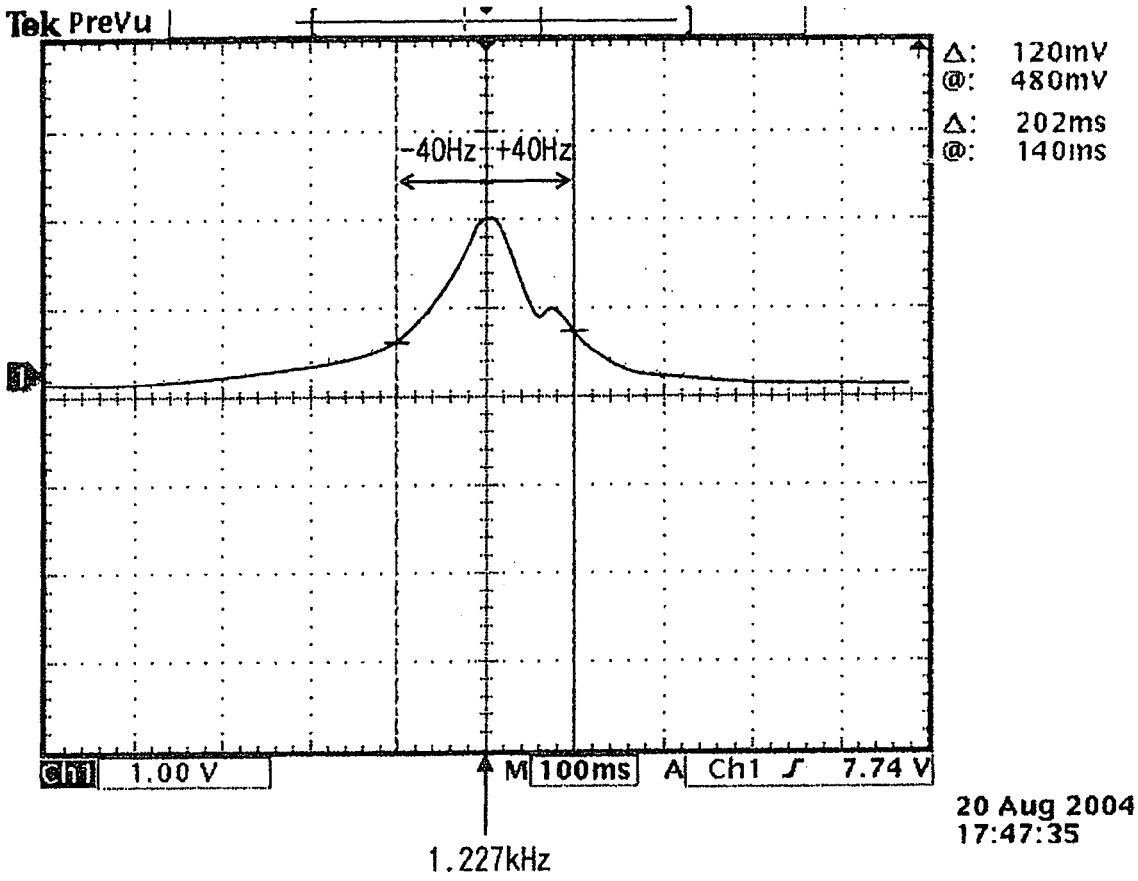
FIG. 6 is a diagram representing a relationship between frequency of the applied alternating voltage signal and the size of the resonance noise, in cases in which the frequency of the alternating voltage signal applied to the charging roller in the image forming device X is swept.
Figure 7:
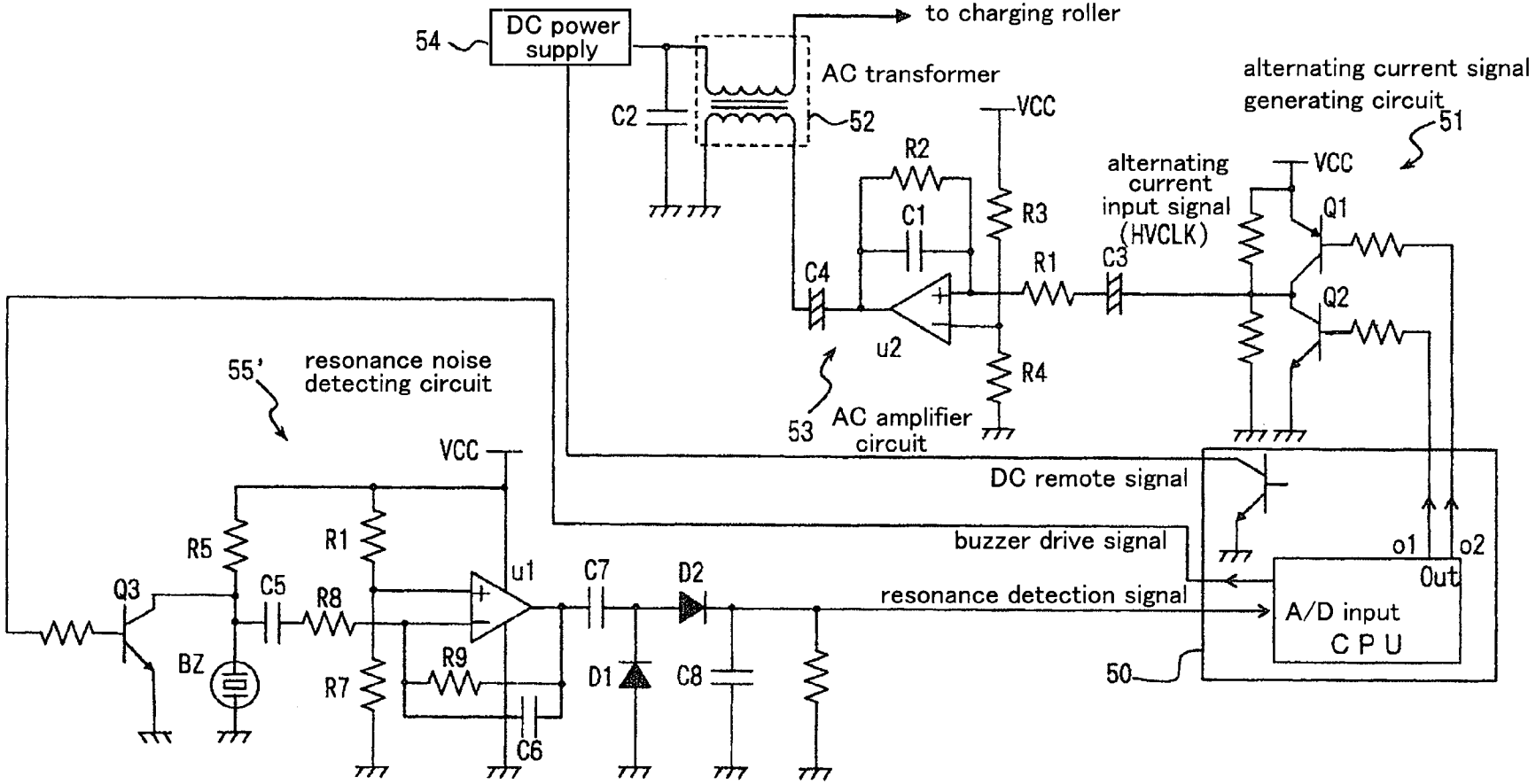
FIG. 7 is a circuit diagram representing another embodiment of the resonance noise detecting circuit for the image forming device X.

Here, FIG. 1 is an overall configuration schematic view of the image forming device X related to the embodiment of the present invention, FIG. 2 is a circuit configuration diagram related to detection of resonance noise and regulation of frequency of alternating voltage applied to a charging roller in the image forming device X, FIG. 3 is a timing chart for an input/output signal of an alternating current signal generating circuit 51 for the image forming device X, FIG. 4 is a block diagram representing an outline configuration of an experimental device used in a resonance confirmation experiment for the image forming device X, FIGS. 5A, 5B, and 5C are diagrams representing wave forms (Ch1) of the alternating voltage signal applied to the charging roller, and wave forms (Ch2) of a detection signal of a resonance noise detecting circuit for the image forming device X, FIG. 6 is a diagram representing a relationship between frequency of the applied alternating voltage signal and the size of the resonance noise, in cases in which the frequency of the alternating voltage signal applied to the charging roller in the image forming device X is swept, and FIG. 7 is a circuit diagram representing another embodiment of the resonance noise detecting circuit for the image forming device X.

Firstly, using FIG. 1, the overall configuration schematic view of the image forming device X related to the embodiment of the present invention is explained.

The image forming device X is an image forming device that uses an electrophotographic method that adopts a contact electrification method for charging a photoreceptor drum surface by bringing into contact a charging roller (an example of a charging member) to which an electrical voltage is applied, and a photoreceptor drum (an example of an image holding body), and in order to prevent non-uniformity of charging (to have equalization of charging) of the photoreceptor drum surface, the image forming device X uses a method in which superimposed voltage, of direct voltage and alternating voltage, is applied to the charging roller.

As shown in FIG. 1, the image forming device X includes: a control unit 50 composed of a computing means, such as a CPU, an ASIC, or the like, and peripheral devices (ROM, RAM, and the like) therefor, an image reader 130 composed of a CCD or the like, for reading an image formed on a document that is automatically fed by an ADF (automatic document feeder) 105 or that is set on a document tray 106, an image forming unit 120 for forming the image that has been read (document image) thereby on a sheet (recording paper), and an operations display unit 107, such as a liquid crystal touch panel or the like, that is disposed on an upper face of the image forming device X, for displaying various types of settings information related to number of sheets to be printed, print enlargement or reduction, type of paper for printing, post-processing modes, and the like, and for enabling a user to perform various types of operation.

The control unit 50 is a control means for overall control of the image forming device X by executing processing according to a predetermined program stored in the ROM. The image forming unit 120 is configured from a photoreceptor drum 121 for holding an electrostatic latent image, a charging roller 123 for uniformly charging each element disposed in the periphery thereof, that is, the surface of the photoreceptor drum 121, an exposure device (not shown in the figure) for irradiating a laser beam onto the surface of the photoreceptor drum 121 to form the electrostatic latent image, a development device 124 for developing the electrostatic latent image, a transfer device 125 for transferring a developed toner image to a sheet, and a cleaning device 122 for removing toner particles that remain on the surface of the photoreceptor drum 121 after transfer.

Also provided are paper feed rollers 112, 113, and 114 for paper-feeding sheets from paper-feeding cassettes 102 and 103, that accommodate the sheets, and a manual paper-feeding tray 104, one sheet at a time, to a sheet feeding path 111, a feeding roller 115, arranged near the sheet feeding path 111, for feeding the sheets to the image forming unit 120, an ejection roller 116 for ejecting the sheets, after image formation, to an ejection tray 204, and a duplex unit 140 for reversing front and back sides of a sheet, when double-side printing, after forming an image, and re-feeding to the image forming unit 120.

Here, in the present image forming device X, an AC contact electrification method in used, in which superimposed voltage, of direct voltage and alternating voltage, is applied to the charging roller 123 (an example of a charging member), and, by this charging roller 123 rotating while in contact with the photoreceptor drum 121 (image holding body), the surface of the photoreceptor drum 121 is uniformly charged.

Additionally, the image forming device X detects the size of the resonance noise (charging noise) generated when the charging roller 123 or the photoreceptor drum 121 resonates with an alternating voltage signal applied to the charging roller 123, and by regulating the frequency of the alternating voltage applied to the charging roller 123 based on the size of the detected resonance noise, curtails generation of the charging noise. Furthermore, in the image forming device X, the charging roller 123 is used as a charging member for the photoreceptor drum 121; however, no limitation is implied here, and, for example, a blade member (charging blade), or the like, can also be used.

Next, using the circuit diagram shown in FIG. 2, circuit configuration related to detection of the resonance noise (charging noise) in the image forming device X, and regulation of the frequency of the alternating voltage applied to the charging roller 123 are explained. As shown in FIG. 2, in the image forming device X, as an example of a resonance noise detecting means for detecting the size of the resonance noise due to the alternating voltage signal applied to the charging roller 123, a piezoelectric device PZ for detecting sound pressure level of the resonance noise, and a resonance noise detecting circuit 55 for processing an output signal of the piezoelectric device PZ are provided.

By the provision of the piezoelectric device PZ for detecting the sound pressure level of the resonance noise, and performing predetermined signal processing on the detection signal of the piezoelectric device PZ, the resonance noise detecting circuit 55 generates a resonance detection signal representing the size (sound pressure level) of the resonance noise. The piezoelectric device PZ is disposed in the vicinity of the charging roller 123 and the photoreceptor drum 121. Furthermore, a piezoelectric element or a sound pressure level sensor such as a condenser microphone, or the like, may be used as the piezoelectric device (sound pressure level sensor).

Next, signal processing for the detection signal of the piezoelectric device PZ in the resonance detecting circuit 55 is explained.

In the detection signal of the piezoelectric device PZ, the direct current component is cut by a condenser C5, and the high frequency alternating current component only is extracted. In addition, the signal of this alternating current component is inputted to a minus (−) input terminal of an operational amplifier u1 that amplifies the detection signal (alternating current component signal) via a resistor R8. Here, in the operational amplifier u1, the detection signal is amplified, and integrated by a condenser C6 and a resistor R9 arranged on a return path, and noise including the high frequency component is removed. That is, the operational amplifier u1 and surrounding circuit perform amplification processing and band-pass filter processing on the detection signal of the piezoelectric device PZ. Here, filter characteristics of the band-pass filter preferably let through frequency components of about two to six times the frequency of the alternating voltage applied to the charging roller 123.

The detection signal amplified by the operational amplifier u1 has its direct current component cut again by a condenser C7, and in addition, is rectified by diodes D1 and D2, and after ripple voltage is smoothed by a condenser C8 and it is completely converted to a direct current signal, it is input to an analog signal input terminal of the control unit 50. The signal inputted to this analog signal input terminal is A/D converted by an A/D conversion circuit built into the control unit 50, is stored in a storage unit built into the control unit 50, and is used in various types of operation by the CPU.

Next, the alternating current signal generating circuit 51 that generates an alternating current input signal (HVCLK), that is a reference signal for the alternating voltage signal applied to the charging roller 123, is explained.

This alternating current signal generating circuit 51, consisting of a transistor and a resistor, as shown in FIG. 2, generates the alternating current input signal (HVCLK) in response to two reference signals o1 and o2 inputted from the control unit 50.

FIG. 3 is a timing chart for an input/output signal of the alternating current signal generating circuit 51.

For a set period t (referred to as a reference period, below), as shown in FIG. 3, when the reference signal o1 with an ON/OFF variation cycle of 4t and an ON/OFF duty ratio of ¼, and the reference signal o2, in which the phase of the reference period t component only is advanced, with respect to the reference signal o1, having an ON/OFF transition cycle of 4t and an ON/OFF duty ratio of ¾, are output by the control unit 50, the alternating current input signal (HVCLK) for the cycle 4t, in which the voltage is switched for each reference period t, as in +Vx→0→−Vx→0→+Vx→ . . . , is generated by the alternating current signal generating circuit 51. This alternating current input signal is converted to an alternating current signal (frequency: ¼ t) by a condenser C3, as shown by a dashed line in FIG. 3.

Accordingly, by varying (regulating) the reference period t for the reference signals o1 and o2, the control unit 50 can regulate (shift) the frequency of the alternating current input signal.

Here, the control unit 50 has a built-in clock signal oscillator, and with this clock signal as reference, generates the two reference signals o1 and o2 and regulates the reference period t.

The alternating current input signal (HVCLK), that is generated by the alternating current signal generating circuit 51 and in which the frequency is regulated by the control unit 50, is converted into a sinusoidal wave reference alternating voltage signal (frequency: ¼ t) by the condenser C3, and the reference alternating voltage signal is amplified by an AC amplifier circuit 53.

Furthermore, the amplified reference alternating voltage signal is superimposed on a direct voltage signal from a DC power supply 54, by an AC transformer 52, and the voltage signal after superimposition is applied to the charging roller 123.

Moreover, the configuration in which the alternating voltage applied to the charging roller 123 is generated and the frequency thereof is regulated (shifted) may, besides the circuit configuration shown in FIG. 2, alternatively be formed of well-known analog transmission circuit, other digital circuits that use gate arrays, or the like.

On the other hand, the control unit 50, when it detects that a predetermined image-forming commencement operation has been indicated from the operations display unit 107, generates, as part of various types of control in image formation in various components of the image forming unit 120, the alternating voltage applied to the charging roller 123 by outputting the reference signals o1 and o2 to the alternating current signal generating circuit 51, and also generates the direct voltage applied to the charging roller 123 by outputting a DC remote signal, that is a predetermined control signal, to the DC power supply 54. In this way, voltage in which the direct voltage and the alternating voltage are superimposed is applied to the charging roller 123, and a state in which image formation operations are underway is entered.

Furthermore, the control unit 50, during the image formation operations (during application of the voltage to the charging roller 123), performs A/D conversion and temporary storage in a storage unit, for a detection signal (resonance detection signal) of the resonance noise detecting circuit 55, and based on the value thereof (referred to as resonance noise detection level, below), performs frequency regulation of the alternating voltage applied to the charging roller 123 (an example of an alternating current frequency regulating means).

Specifically, the control unit 50 judges whether or not the resonance noise detection level (that is, the size of the resonance noise) had exceeded a set tolerance level stored in advance in the storage unit, and in cases where the set tolerance level is exceeded, shifts the frequency of the alternating voltage applied to the charging roller 123 by a predetermined frequency amount only, in a plus direction or in a minus direction. This is performed by changing the reference period t for the reference signals o1 and o2, supplied to the alternating current signal generating circuit 51, by a preset regulation period Δt only, in a plus direction or a minus direction.

In this way, the frequency of the applied alternating voltage deviates from the resonance frequency band of the device, and generation of the resonance noise can be assuredly reduced. Moreover, since frequency regulation of the applied alternating voltage is performed only when generation of the resonance noise or symptoms thereof is detected, adverse affects on image quality can be kept to a minimum.

Below, an experiment to confirm the extent to which the frequency of the alternating voltage applied to the charging roller 123 should be regulated in order to be able to reduce the resonance (referred to as resonance confirmation experiment, below) is explained.

FIG. 4 is a block diagram representing a schematic configuration of an experimental device used in the resonance confirmation experiment for the image forming device X.

In the abovementioned resonance confirmation experiment, the voltage, in which the direct voltage and the alternating voltage, from the DC power supply 54 and an AC power supply 52*a* consisting of the AC transformer 52 and the AC amplifier circuit 53, are superimposed, as shown in FIG. 2, is applied to the charging roller 123, and the size of the resonance noise of the charging roller 123 or the photoreceptor drum 121, generated by the applied alternating voltage, is detected by the piezoelectric device PZ and the resonance noise detecting circuit 55.

Furthermore, the AC power supply 52*a* supplies an alternating current signal (a sine wave) by a function generator 62, and its frequency is set at a desired value. By regulating the frequency of the output signal of the function generator 62, the frequency of the alternating voltage applied to the charging roller 123 is regulated.

Moreover, the voltage signal applied to the charging roller 123 and the detection signal of the resonance noise detecting circuit 55 are analyzed by a digital oscilloscope 61. Furthermore, the voltage signal applied to the charging roller 123 is taken in by the digital oscilloscope 61 via a high pressure probe 63.

Next, referring to FIGS. 5A, 5B, 5C, and FIG. 6, using the experimental device shown in FIG. 4, results measured by the digital oscilloscope 61 are explained.

Here, FIGS. 5A, 5B, and 5C represent wave forms (upper half, Ch1) of various alternating voltage signals applied to the charging roller 123, and wave forms (lower half, Ch2) at a point (*A) (see FIG. 2) of the resonance noise detecting circuit 55, and indicate measured data for cases in which the frequencies of the various applied alternating voltage signals are 1.227 kHz,1.263 kHz, and 1.188 kHz.

As may be understood from FIG. 5A, in the present experimental device, in cases where the frequency of the alternating voltage signal applied to the charging roller 123 is 1.227 kHz, it is understood that the level (amplitude) of the detection signal of the resonance detecting circuit 55 becomes large and resonates.

Furthermore, as may be understood from FIGS. 5B and 5C, if the frequency of the applied alternating voltage signal is shifted from the resonance frequency (1.227 kHz) by approximately +40 Hz (+36 Hz in the experiment), or by approximately −40 Hz (−39 Hz in the experiment), the resonance noise level (amplitude) can be reduced to approximately ⅓ of what it would otherwise be.

In addition, it is understood from FIG. 5A that resonance occurs at a frequency of approximately four times the frequency of the alternating voltage signal applied to the charging roller 123. Furthermore, FIG. 6 indicates the relationship between the frequency of the applied alternating voltage for cases where the frequency of the alternating voltage applied to the charging roller 123 is swept (horizontal axis), and the signal level at a point (*B) (see FIG. 2) of the resonance detecting circuit 55, that indicates the size of the resonance noise (vertical axis).

From FIG. 6, it is understood that the more the frequency of the applied alternating voltage is shifted from the resonance frequency (approximately 1.227 kHz) in a plus direction or in a minus direction, the smaller the level of the resonance noise (signal level at point *B). From FIG. 6 it is also understood that if the frequency of the applied alternating voltage is shifted from the resonance frequency (approximately 1.227 kHz) in a plus direction or in a minus direction, by approximately 40 Hz (approximately 3.3% of the resonance frequency) only, the resonance noise level can be reduced to about ⅓ of what it would otherwise be.

As shown in FIGS. 5A, 5B, and 5C and in FIG. 6, it is possible to find by measurement in advance to what extent the frequency of the alternating voltage applied to the charging roller 123 should be shifted to be able to reduce the resonance.

Accordingly, in cases where the level of the detection signal of the resonance noise detecting circuit 55 exceeds the set tolerance level, if a shift equal to the frequency shift measured in advance, only, is made in a plus direction or a minus direction, by the control unit 50, the resonance noise can be adequately curtailed. Furthermore, by making the set tolerance level a little lower than the detection level when resonance is generated, it is possible to perform frequency regulation at stages when symptoms of resonance occur, and to prevent resonance generation from occurring.

Here, based on results of FIGS. 5A, 5B, and 5C, and FIG. 6, in cases where resonance generation or symptoms thereof are detected, the shift band for the frequency of the applied alternating voltage signal may, for example, be about 40 Hz to 50 Hz (about 3% to 4% of the frequency of the applied alternating voltage signal when resonance is detected.) If this is converted to the regulating period Δt of the reference period t in the frequency regulation method shown in FIGS. 2 and 3, it is of the order of 7 micro-seconds to 9 micro-seconds. Furthermore, when the resonance frequency is 1 kHz, in cases where it is shifted by 50 Hz, the regulation period Δt of the reference period t is about 12 micro-seconds.

Possibilities include deciding in advance whether to shift in the plus direction or in the minus direction, setting the reference frequency of the applied alternating voltage signal in advance and shifting in a direction that approaches the reference frequency, or performing actual trial shifts in various plus directions and minus directions, and finally shifting in the direction in which the level of the detection signal by the resonance detecting circuit 55 decreases (that is, the direction in which the resonance noise decreases).

Incidentally, in the resonance noise detecting circuit 55 shown in FIG. 2, the piezoelectric device PZ is used as the detector for the resonance noise; however, alternatively, an embodiment in which a buzzer sound output unit (that is, a speaker) in a warning buzzer output circuit, provided in general image forming devices including the present image forming device X, that gives warnings when it runs out of paper, when there is a paper jam, or when various other error conditions are generated, is dually used as a detector for detecting the size of the resonance noise.

Below, using the circuit diagram of FIG. 7, a resonance noise detecting circuit 55' related to this type of embodiment is explained.

Since the resonance noise detecting circuit 55' related to this type of embodiment is largely the same as the resonance noise detecting circuit 55 (FIG. 2), here, only parts that differ from the resonance noise detecting circuit 55 are explained. Furthermore, in FIG. 7, constituent elements that are the same as those shown in FIG. 2 are represented with the same reference symbols.

As a warning buzzer output circuit, in the image forming device X, a transistor Q3 for driving the warning buzzer, and a buzzer output unit BZ (that is, a speaker) connected to the output side of the transistor Q3 are provided. By controlling the ON/OFF buzzer drive signals (for example, rectangular wave form frequencies of about 1 kHz) for the transistor Q3, the control unit 50 can control whether or not to output the buzzer sound. Based on the detection result of the paper sensor and paper jam sensor (not shown in the figure) the control unit 50 controls whether or not to output the buzzer sound.

On the other hand, the resonance noise detecting circuit 55' shown in FIG. 7 has a circuit configuration in which the piezoelectric device PZ of the resonance noise detecting circuit 55 (FIG. 2) is replaced by the buzzer sound output unit BZ. In this way, the buzzer sound output unit BZ of the warning buzzer output circuit (warning buzzer output means) can be dually used as a detector for detecting the size of the resonance noise generated by the applied alternating voltage signal. Here, since the buzzer sound output unit BZ is a speaker in which an electrical signal is converted into a sound (vibration), while the buzzer drive signal is OFF, by transmitting the resonance noise, it functions as a microphone for generating an electrical signal at a level that corresponds to the size (strength) of the resonance noise. If the level of this electrical signal is detected, the size of the resonance noise can be detected. In such cases, it is desirable that the buzzer sound output unit BZ be disposed close to the charging roller 123 and the photoreceptor drum 121.

By this type of configuration, the existing warning buzzer can also be dually used as a detector of the resonance noise, so that a new piezoelectric device need not be provided, and a simpler and cheaper device can be configured.

INDUSTRIAL APPLICABILITY

The present invention can be used in an image forming device.

What is claimed is:

1. An image forming device that performs charging of a surface of an image holding body by applying superimposed voltage, of direct voltage and alternating voltage, to a charging member in contact with the image holding body, the image forming device comprising:

a resonance noise detecting means for detecting size of resonance noise by a signal of the alternating voltage;

an alternating current frequency regulating means for regulating frequency of the alternating voltage based on the size of the resonance noise detected by the resonance noise detecting means, and the alternating current frequency regulating means shifting the frequency of the alternating voltage in a plus direction or in a minus direction by a preset frequency amount only in cases where the size of the resonance noise detected by the resonance noise detecting means exceeds a preset size.

2. The image forming device according to claim 1, wherein the resonance noise detecting means detects the size of the resonance noise by detecting sound pressure level of the resonance noise using a piezoelectric device.

3. The image forming device according to claim 1, wherein the resonance noise detecting means dually uses a buzzer sound output unit in a warning buzzer output means as a detector for detecting the size of the resonance noise.

4. The image forming device according to claim 1, wherein the amount the alternating current frequency regulating means shifts the frequency of the alternating voltage is preset by advance measurement.

5. The image forming device according to claim 4, wherein the amount the alternating current frequency regulating means shifts the frequency of the alternating voltage is approximately 3% to 4% of the frequency of the alternating voltage when resonance is detected.

6. The image forming device according to claim 1, wherein a set tolerance level stored in a control unit of the image forming device is lower than a resonance noise detection level.

7. The image forming device according to claim 3, wherein the warning buzzer is arranged in proximity to the photoreceptor drum and the charging roller.

8. The image forming device according to claim 1, wherein a piezoelectric device is arranged in proximity to the photoreceptor drum and the charging roller.

9. The image forming device according to claim 8, wherein the piezoelectric device is arranged between the charging member and a development device.

* * * * *